US007967079B2

(12) United States Patent
Stierle et al.

(10) Patent No.: US 7,967,079 B2
(45) Date of Patent: Jun. 28, 2011

(54) HAND-HELD POWER TOOL

(75) Inventors: Peter Stierle, Waldenbuch (DE); Albrecht Hofmann, Steinenbronn (DE); Juergen Wiker, Leinfelden-Echterdingen (DE); Mario Pauli, Gundelsheim (DE); Stefan Heess, Leinfelden-Echterdingen (DE); Thomas Schomisch, Filderstadt (DE); Meinhard Eule, Aichtal (DE); Markus Heckmann, Leinfelden-Echterdingen (DE); Kersten Heckmann, legal representative, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 11/568,888

(22) PCT Filed: Feb. 13, 2006 (Under 37 CFR 1.47)

(86) PCT No.: PCT/EP2006/050868
§ 371 (c)(1), (2), (4) Date: Mar. 3, 2008

(87) PCT Pub. No.: WO2006/108727
PCT Pub. Date: Oct. 19, 2006

(65) Prior Publication Data

US 2008/0202784 A1 Aug. 28, 2008

(30) Foreign Application Priority Data

Apr. 11, 2005 (DE) ..... 10 2005 016 453

(51) Int. Cl.
*B25D 17/24* (2006.01)

(52) U.S. Cl. ..... 173/216; 173/162.2; 173/217

(58) Field of Classification Search ..... 173/217, 173/162.1, 162.2, 170, 216, 210, 211
See application file for complete search history.

(56) References Cited

U.S. PATENT DOCUMENTS

| | | | | |
|---|---|---|---|---|
| 4,800,965 | A * | 1/1989 | Keller | 173/162.2 |
| 5,213,167 | A * | 5/1993 | Best et al. | 173/162.2 |
| 5,692,574 | A | 12/1997 | Terada | |
| 5,697,456 | A * | 12/1997 | Radle et al. | 173/162.2 |
| 5,927,407 | A * | 7/1999 | Gwinn et al. | 173/162.2 |
| 6,148,930 | A * | 11/2000 | Berger et al. | 173/162.2 |
| 6,220,367 | B1 * | 4/2001 | Masterson et al. | 173/162.2 |
| 6,619,409 | B2 * | 9/2003 | Iida | 173/162.2 |
| 6,805,207 | B2 * | 10/2004 | Hagan et al. | 173/170 |

FOREIGN PATENT DOCUMENTS

| | | |
|---|---|---|
| DE | 40 00 861 | 7/1991 |
| DE | 42 11 316 | 10/1993 |
| DE | 100 55 395 | 5/2002 |
| DE | 102 44 793 | 4/2004 |
| WO | 2004/016399 | 2/2004 |

* cited by examiner

*Primary Examiner* — Scott A. Smith
(74) *Attorney, Agent, or Firm* — Michael J. Striker

(57) ABSTRACT

A portable power tool includes a motor housing (22*a*, 22*b*, 22*c*, 22*d*, 68) and a housing cover (26*a*, 26*b*, 26*c*, 26*d*, 72) that is attached to the motor housing (22*a*, 22*b*, 22*c*, 22*d*, 68). The portable power tool includes insulation (44*a*, 44*b*, 44*c*, 44*d*, 70*a*, 70*b*) adjacent to the motor housing (22*a*, 22*b*, 22*c*, 22*d*, 68) and the housing cover (26*a*, 26*b*, 26*c*, 26*d*, 72), which are guided through a guide (50*a*, 50*b*, 50*c*, 50*d*, 52*a*, 52*b*, 52*d*, 92) in the direction toward the motor housing (22*a*, 22*b*, 22*c*, 22*d*, 68) and/or the housing cover (26*a*, 26*b*, 26*c*, 26*d*, 72).

22 Claims, 5 Drawing Sheets

HAND-HELD POWER TOOL

BACKGROUND OF THE INVENTION

The present invention is directed to a hand-held power tool.

Portable power tools are known that include a housing that includes a motor housing and a cup-shaped housing cover. The motor housing encloses internal components, e.g., an electric motor, and the cup-shaped housing cover encloses further electrical components, e.g., switches, power supply, etc. When the portable power tool is in the assembled state, the cup-shaped housing cover is attached to the motor housing in the axial direction of the housing cover. The housing is sealed by way of the fact that the housing cover and the motor housing bear against each other without play. This is made possible by designing the motor housing and the housing cover accordingly, and by using a press during assembly.

SUMMARY OF THE INVENTION

The present invention relates to a portable power tool with a motor housing and a housing cover that is attached to the motor housing.

It is provided that the portable power tool includes insulation means, which are adjacent to the motor housing and the housing cover, and which are guided through a guide means in the direction toward the motor housing and/or the housing cover. Using the insulation means, an interior space enclosed by the housing can be insulated to the outside, and the formation of an electrical bridge composed, e.g., of metal and/or carbon dust, and extending from the motor to the operator's hand, can be effectively prevented, by way of which a high level of safety for the operator can be ensured. As an alternative, or in addition thereto, the housing cover and the motor housing can be insulated from each other, in order to minimize a transfer of vibrations from the motor housing to the housing cover. As a result, a high level of comfort for the operator can be attained. This insulation against vibrations, which can be attained via the selection of the design and/or material of the insulation means, is particularly suited for use, e.g., in sanders, in the case of which vibrations are produced, e.g., via imbalances in a rotating grinding disc.

Via the guide means, e.g., a stop element in the motor housing or in the housing cover, displacement of the insulation means in the axial direction in the motor housing or in the housing cover, e.g., when the housing cover is slid onto the motor housing, can be prevented. This prevents an undesired squeezing of the insulation means between the motor housing and the housing cover and, as a result, a poor seal.

The insulation means are preferably composed of an elastic material, such as an elastomer or a plastic, which is provided to dampen vibrations. Since the interior space can be sealed off from the outside by the insulation means, a great amount of assembly effort, e.g., adapting the housing cover exactly to the motor housing or using a press, can be avoided. The motor housing can be the part of the housing into which a motor of the portable power tool is inserted, e.g., during assembly.

A high level of comfort in operating the portable power tool can be attained when the housing cover is shaped like a cup and, in particular, when it is attached to the motor housing in the axial direction. An operator can guide the portable power tool primarily via the housing cover, and the housing cover can be damped well against vibrations that are caused by the motor and are transferred to the motor housing. The axial direction can be the axial direction of the cup-shaped housing cover. The insulation means are guided in the axial direction. The housing cover can be composed of one or more components; parts of a multiple-component housing cover can be installed laterally. The housing cover is preferably located on the side of the portable power tool opposite to a tool.

Advantageously, the guide means are part of a shoulder in the motor housing or in the housing cover. Via this configuration of the present invention, the insulation means can be installed on the guide means with a small amount of assembly effort. In addition, assembly errors, such as an undesired squeezing of the insulation means in a guide means designed, e.g., as a groove, can be prevented.

It is also provided that the insulation means are guided in the radial and axial directions via the interaction of motor housing and housing cover. Guidance errors can be prevented by way of these guide means. In addition, the insulation means can be positioned between the housing cover and the motor housing in a compact manner by adapting the design of the insulation means to the corresponding design of the motor housing and the housing cover.

In a further embodiment of the present invention, the insulation means include recesses. As a result, the insulation means can be connected, e.g., in the tangential direction, with the motor housing and/or the housing cover in a form-fit manner, which prevents the insulation means from rotating during operation of the portable power tool.

The portable power tool advantageously includes interior elements, which are located inside the motor housing and/or the housing cover, and which engage in the recesses. This makes it possible to design the insulation means with the interior components of the portable power tool, e.g., a carbon brush holder, to be compact, since the insulation means are adapted to the configuration of these interior components.

Advantageously, the insulation means are bonded with the motor housing or the housing cover. Assembly errors and a loss of the insulation means, e.g., during repair, can be prevented. The bond can be created by integrally extruding the insulation means onto the housing cover or the motor housing, or via gluing, soldering, welding or fusing.

In a further embodiment of the present invention, it is provided that the insulation means are manufactured with at least two parallel outer surfaces; in the installed state, at least one of these outer surfaces bears against the motor housing and the other outer surface bears against the housing cover. This design of the insulation means is suited, in particular, for damping the vibrations that are directed toward the outer surfaces at least largely perpendicularly, the vibrations being transferred from the motor housing to the housing cover.

It is also provided that the insulation means include at least one recess, which is formed in the axial direction. An efficient damping of vibrations oriented in the axial direction and in the radial direction can be attained, because the insulation means are highly flexible in the axial direction. In addition, the recess can serve as space into which the insulation means can expand in the axial direction.

A complete seal of the motor housing and the housing cover can be easily attained by the fact that the insulation means bear against the motor housing and the housing cover in a closed, annular manner.

The insulation means advantageously bear in an open, annular manner against the motor housing and the housing cover, and they include a gap, particularly in the radial direction. Due to the break in the annular insulation means, a high level of elasticity of the insulation means in the radial direction is attained; this makes it possible to use high levels of material hardnesses, e.g., polyamide, in the manufacture of the insulation means.

To attain a complete seal of the motor housing and the housing cover, the motor housing can include a rib, which is located in the gap.

In an advantageous refinement of the present invention, the insulation means—which have been preloaded in the radial direction—are mounted on the motor housing or the housing cover. The insulation means do not rest loosely against the motor housing or the housing cover. Instead, they exert pressure, via their own force, in the radial direction on the motor housing and/or the housing cover. Assembly errors and the loss of the insulation means, e.g., during repair, can be prevented as a result.

A further embodiment provides that the insulation means surround the housing cover or the motor housing in the shape of an L. By way of this form-fit connection, which is adapted to an edge, a shearing-off of the insulation means by the edge is prevented when the portable power tool is assembled, e.g., when the housing cover is slid onto the motor housing.

A stop is also provided, which prevents the insulation means from being compressed completely. In this manner, a "squishing" of the insulation means, which is located between the motor housing and the housing cover, is prevented, e.g., when the portable power tool is dropped and strikes an object.

BRIEF DESCRIPTION OF THE DRAWINGS

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DETAILED DESCRIPTION OF THE EXEMPLARY EMBODIMENTS

Figure 1:
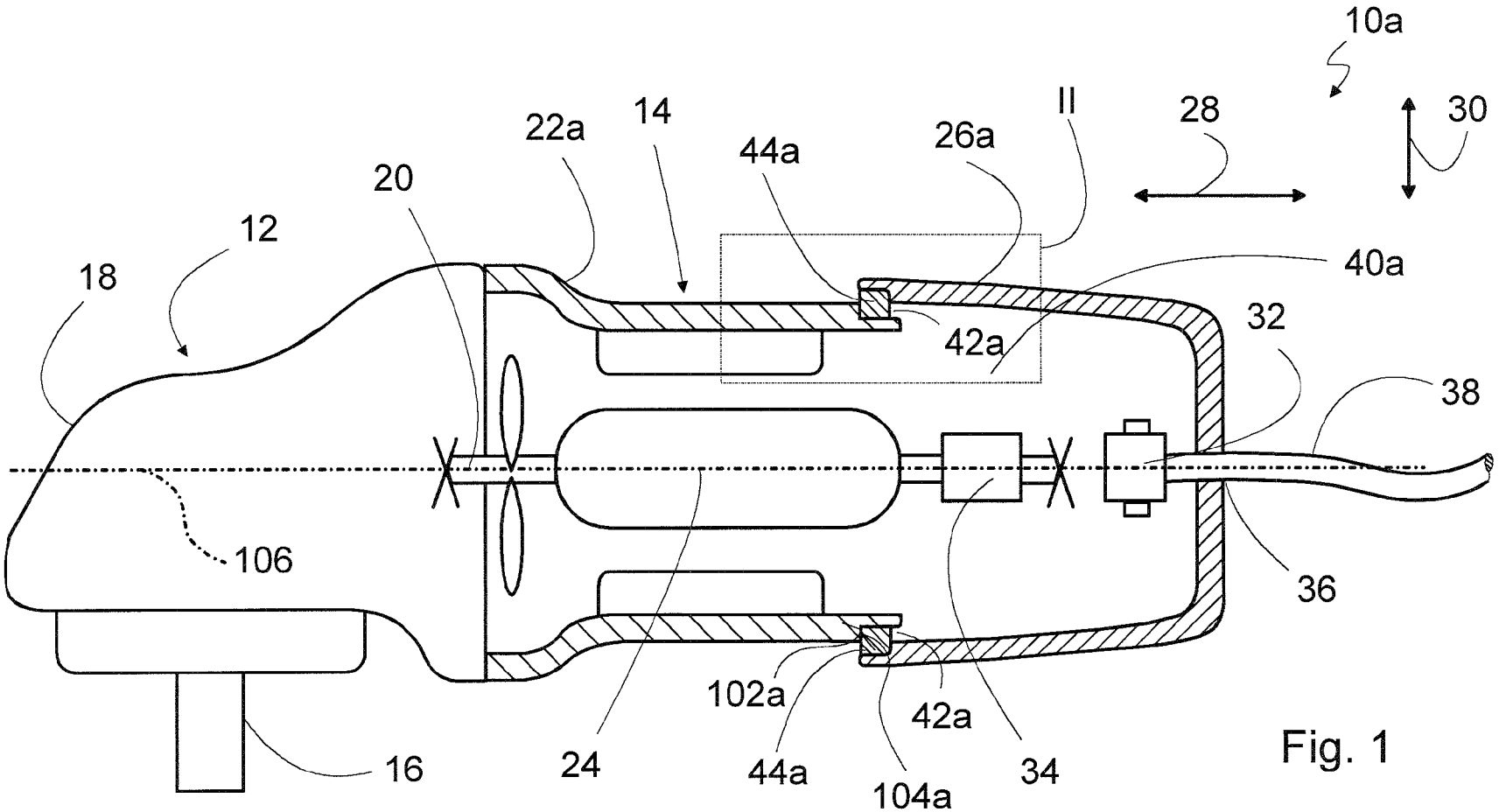
FIG. 1 shows a side view of an angle grinder with a motor housing, a housing cover, and an insulation means.

FIG. 1 shows a sectional view of an angle grinder 10*a* with a front part 12 and a rear part 14. Front part 12 includes an output shaft 16 and a gearbox housing 18, which encloses a transmission, which connects output shaft 16 with a motor shaft 20 and is not shown in the figure. A grinding disc designed to grind surfaces can be mounted on output shaft 16. Rear part 14 includes a motor housing 22*a*, which encloses an electric motor 24, and a cup-shaped housing cover 26*a*—with an axial direction 28 and a radial direction 30—which is mounted on motor housing 22*a* and covers a switch 32 and a carbon brush holder 34. A power cord 38 is guided through an opening 36 of housing cover 26*a*. Motor housing 22*a* and housing cover 26*a* enclose an interior space 40*a*. Insulation means 44*a* are located in a gap 42*a* between motor housing 22*a* and housing cover 26*a*, insulation means 44*a* bearing in a closed, annular manner against motor housing 22*a* and housing cover 26*a*. They insulate interior space 40*a* to the outside, and they insulate housing cover 26*a* against motor housing 22*a*.

Figure 2A:
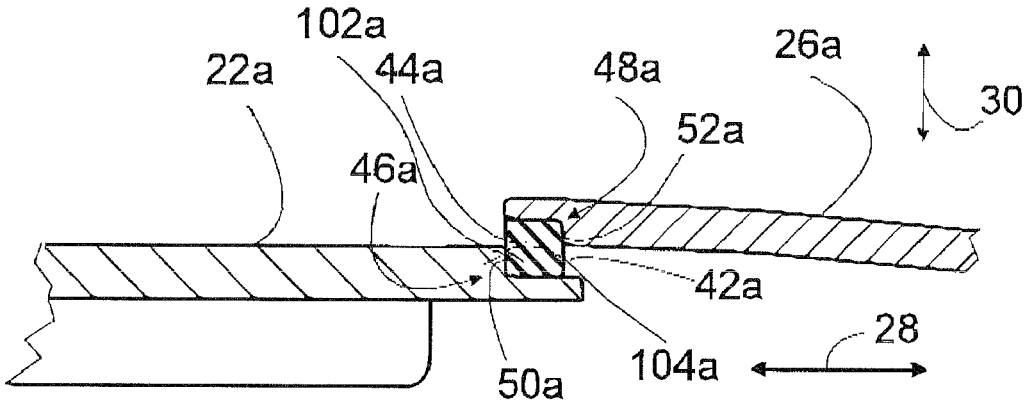
FIG. 2*a* shows an enlarged section of FIG. 1.

FIG. 2*a* shows an enlargement of section 11 in FIG. 1. Motor housing 22*a* and housing cover 26*a* each include a shoulder 46*a* and 48*a*, respectively. Insulation means 44*a* are guided in axial direction 28 by a guide means 50*a* in motor housing 22*a* and/or a further guide means 52*a* in housing cover 26*a*, both guide means 50*a* and 52*a* being designed as a section of shoulders 46*a*, 48*a*, respectively, which are oriented in radial direction 30.

During operation of angle grinder 10*a*, carbon dust can be produced in interior space 40*a*. In addition, metallic grinding dust can surround angle grinder 10*a* and be drawn by the motor fan into interior space 40*a*, where it deposits.

By way of insulation means 44*a*, which insulate interior space 40*a* to the outside in the region of gap 42*a*, gap 42*a* can be effectively prevented from filling with this dust, which also effectively prevents resultant electrical bridges from electric motor 24 to a hand of the operator, thereby ensuring safety. In addition, insulation means 44*a* can prevent an operator from experiencing vibrations in axial direction 28 and radial direction 30, the vibrations being transferred from motor housing 22*a* to housing cover 26*a*.

In a first step of assembling angle grinder 10*a*, insulation means 44*a*—which can be manufactured with a smaller inner diameter than the diameter of shoulder 46*a* and are subsequently preloaded in radial direction 30—are placed on shoulder 46*a* until they bear, in an annular manner, against guide means 50*a*. In a second assembly step, housing cover 26*a* is slid in axial direction 28 onto insulation means 44*a*, by way of which insulation means 44*a* bear in an annular manner against guide means 52*a*. Via the interaction of guide means 50*a* and 52*a*, an undesired squeezing of insulation means 44*a* between motor housing 22*a* and housing cover 26*a*, and a resultant poor sealing-off of interior space 40*a*, can be prevented in the second assembly step.

Figure 2B:
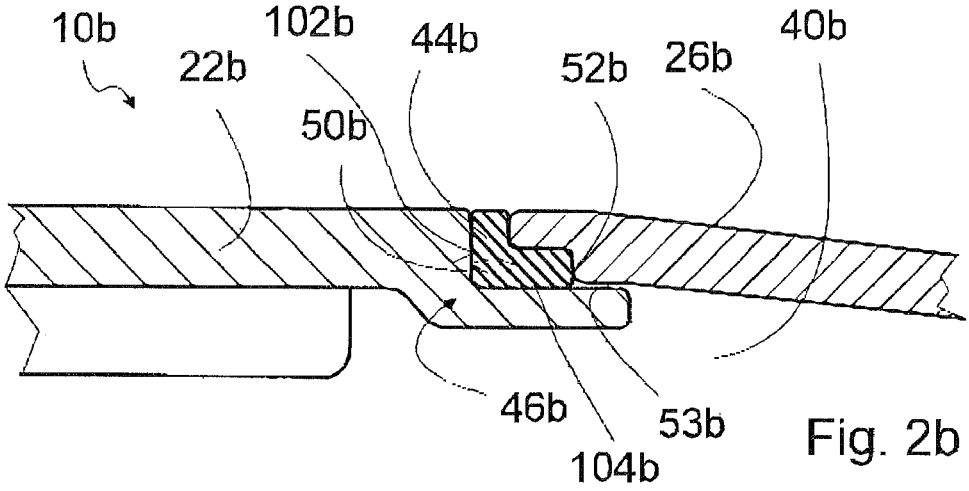
FIG. 2*b* shows alternative insulation means.

FIG. 2*b* shows a section of an alternative angle grinder 10*b*, which includes a motor housing 22*b* with a guide means 50*b*, a housing cover 26*b* with a guide means 52*b*, and an insulation means 44*b*. Housing cover 22*b* and motor housing 22*b* enclose an interior space 40*b*. Insulation means 44*b* surrounds housing cover 26*b* in the shape of an L, and they can be integrally extruded onto it. As a result, a shearing-off of insulation means 44*b* by an edge of housing cover 26*b* can be prevented when housing cover 26*b* is slid onto motor housing 22*b*. In addition, insulation means 44*b* are visible to an operator. As an alternative, insulation means 44*b* can be designed such that they surround motor housing 22*b* in the shape of an L. Insulation means 44*b* can be manufactured with a smaller inner diameter than the diameter of shoulder 46*b* and, in the installed state, they can exert pressure via their own force against motor housing 22*b*, which creates a good seal of interior space 40*b* to the outside. In addition, motor housing 22*b* and housing cover 26*b* form a gap 53*b*, the function of which is described with reference to FIG. 2*d*.

Figure 2C:
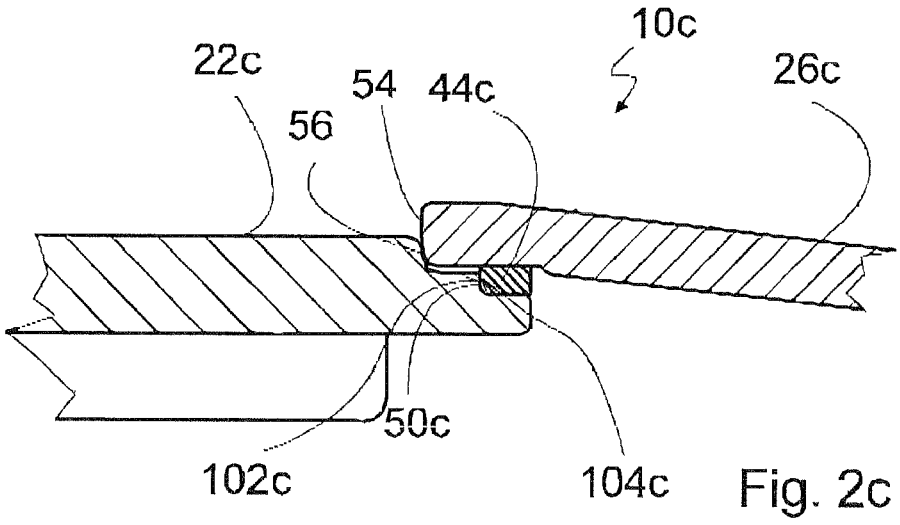
FIG. 2*c* shows further insulation means, which are bonded with the motor housing.

FIG. 2*c* shows a section of an alternative angle grinder 10*c*. Angle grinder 10*c* includes a motor housing 22*c* with guide means 50*c*, a housing cover 26*c*, and insulation means 44*c*, which are bonded with motor housing 22*c*. The bond can be created by integrally extruding insulation means 44*c* onto motor housing 22*c*, or via gluing or fusing. During assembly of angle grinder 10*c*, housing cover 26*c* is slid onto insulation means 44*c* until an end face 54 touches an edge 56 of motor housing 22*c*. When angle grinder 10*c* is disassembled, e.g., during repair, insulation means 44*c* remain adjacent to motor housing 22*c* due to the bond. This prevents insulation means 44*c* from becoming lost, and it prevents assembly errors from occurring when angle grinder 10*c* is assembled. As an alternative, insulation means 44*c* can be bonded with housing cover 26*c*.

Figure 2D:
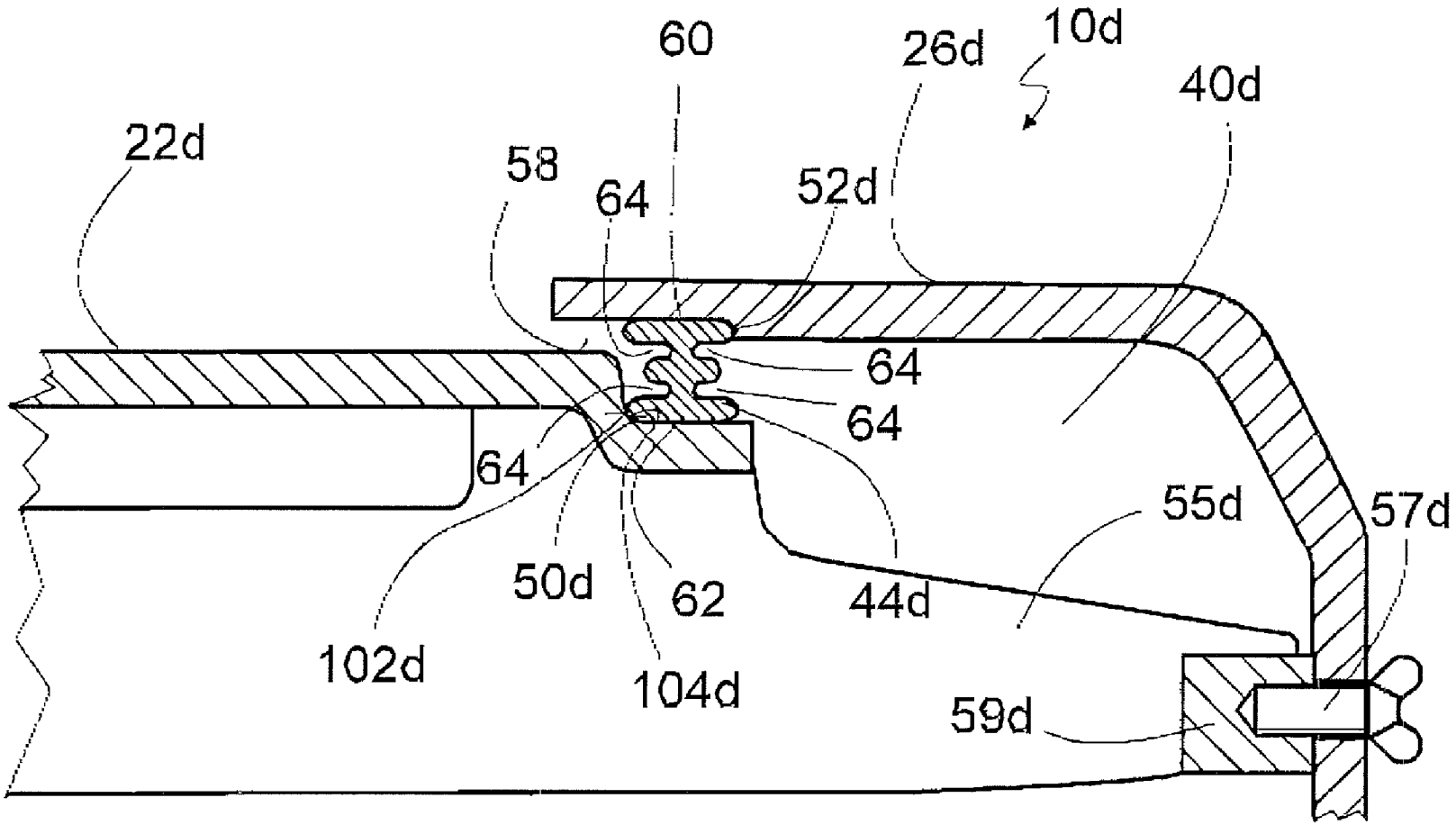
FIG. 2*d* shows further insulation means.

FIG. 2*d* shows an alternative angle grinder 10*d* with a housing cover 26*d*, which includes guide means 52*d*, insulation means 44*d*, and a motor housing 22*d*, which includes guide means 50*d* and a stop 58 designed as a contact surface. Housing cover 26*d* and motor housing 22*d* enclose an interior space 40*b*. Housing cover 26*d* is fastened to interior elements 55*d* of angle grinder 10*d* by a screw 57*d*, which is screwed into a screw bearing 59*d*. Insulation means 44*d* are manufactured with a first outer surface 60 and a second outer surface 62, which is oriented parallel to first outer surface 60. In the assembled state of angle grinder 10*d*, outer surface 60 bears against housing cover 26*d*, and outer surface 62 bears against motor housing 22*d*. In addition, insulation means 44*d* are provided with several recesses 64 formed in axial direction 28.

During operation of angle grinder 10*d*, vibrations, which are transferred from motor housing 22*d* to housing cover 26*d*, can be damped by insulation means 44*d*. Vibrations that are oriented perpendicularly to outer surfaces 60 and 62 can be efficiently damped by a deformation of insulation means 44*d*, since space is provided for insulation means 44*d*—in the form of recesses 64—to deform in axial direction 28. Via recesses 64, great flexibility of insulation means 44*d* in axial direction 28 is also attained, which ensures efficient damping of vibrations oriented in axial direction 28. Insulation means 44*d* can bear, e.g., in a closed, annular manner, against motor housing 22*d* and housing cover 26*d*, which creates a good sealing-off of interior space 40*d*, or it can include several, separate segments, which creates additional installation space between the segments. In addition, vibrations that are transferred by interior elements 55*d* via screw bearing 59*d* and screw 57*d* to housing cover 26*d* can be damped via the selection of the material of screw bearing 59*d*, e.g., an elastic material. When high pressure is exerted from the outside in radial direction 30 onto housing cover 26*d*, e.g., when angle grinder 10*d* is dropped, stop 58—which is designed as a contact surface—prevents insulation means 44*d* from being completely compressed, since housing cover 26*d* strikes stop 58.

Figure 3:
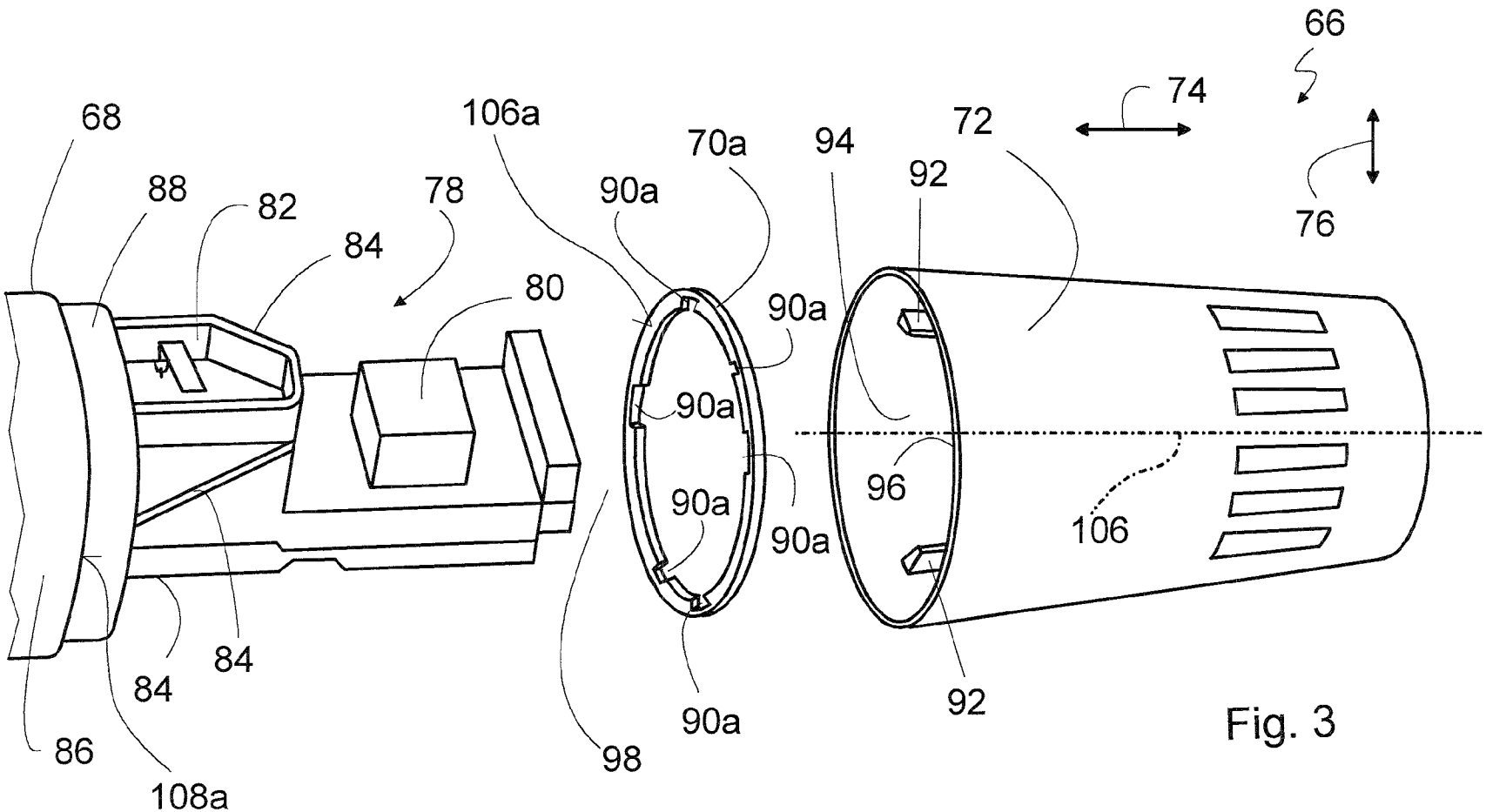
FIG. 3 shows an exploded view of part of an angle grinder with a motor housing, a housing cover, and an insulation means with a closed, annular configuration.

FIG. 3 shows an exploded view of a part of an angle grinder 66 that includes a motor housing 68, a closed, annular insulation means 70*a* made of hard rubber, and a cup-shaped housing cover 72 with an axial direction 74 and a radial direction 76; in the assembled state, cup-shaped housing cover 72 encloses interior elements 78. Interior elements 78 include a switch 80, a carbon brush holder 82, and walls 84. Motor housing 68 has an inner surface 86, which forms a shoulder with a projection 88. Insulation means 70*a* include several recesses 90*a* into which walls 84 engage when angle grinder 66 is in the assembled state. Housing cover 72 includes several guide means 92 designed as ribs, which are located on an interior side 94 of housing cover 72. Guide means 92 are displaced in axial direction 74 behind an inner edge 96 of housing cover 74 and extend to rear wall of housing cover 72. In addition, motor housing 68 and housing cover 72 enclose an interior space 98 when angle grinder 66 is in the assembled state.

In a first step of assembling angle grinder 66, insulation means 70*a*—which are manufactured with a larger outer diameter than the inner diameter of inner side 94 and which have been preloaded in radial direction 76—are inserted into housing cover 72. After insertion, insulation means 70*a* exert pressure via their own force onto housing cover 72. In a second assembly step, housing cover 72—with inserted insulation means 70*a*—is slid onto projection 88 until insulation means 70*a* touch the end face of projection 88 and are slid backward by it in axial direction 74 until they bear against guide means 92, which are designed as ribs.

Figure 4:
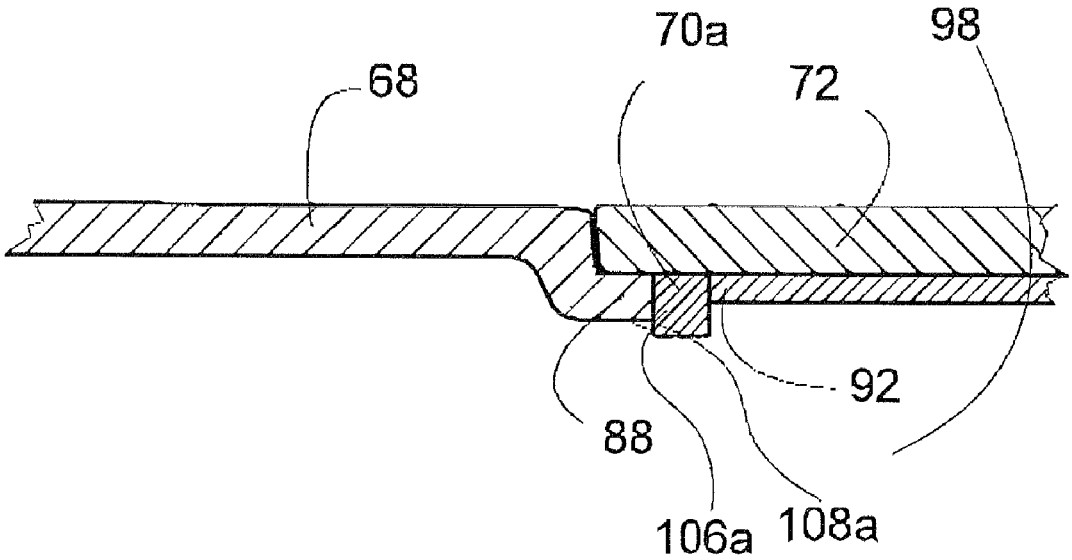
FIG. 4 shows a sectional view of section of the angle grinder in FIG. 3, in the assembled state.

FIG. 4 shows a sectional view of a section of angle grinder 66 in the assembled state. Insulation means 70*a* bear against the end face of projection 88 and against guide means 92. By locating insulation means 70*a* in axial direction 74 behind projection 88, a compact design in radial direction 76 is ensured. Due to the preload, insulation means 70*a* remain in housing cover 72 when housing cover 72 is removed from motor housing 68, e.g., during repair, which can prevent insulation means 70*a* from becoming lost, and it can prevent assembly errors from being made when angle grinder 66 is assembled.

Figure 5:
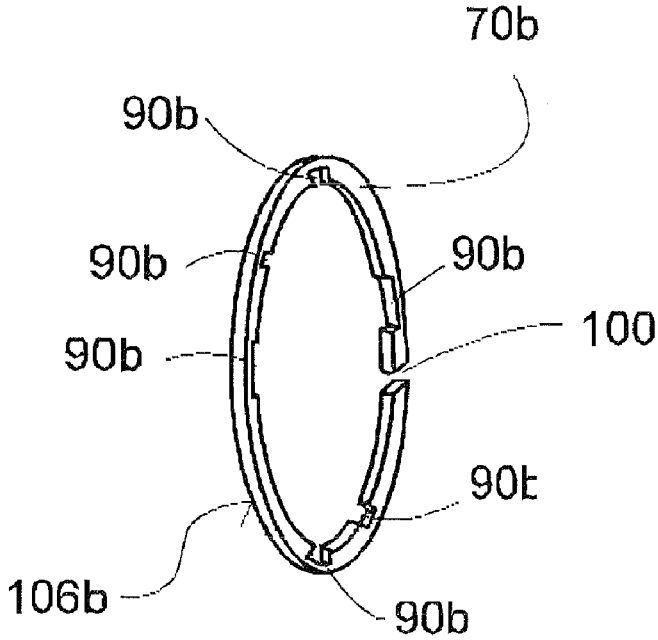
FIG. 5 shows insulation means with an open, annular configuration.

FIG. 5 shows alternative insulation means 70*b*, which include recesses 90*b* and a gap 100 in radial direction 76, and which are made of a harder material, e.g., polyamide, than insulation means 70*a*. Compared with insulation means 70*a*, insulation means 70*b*—due to gap 100—has a great deal of flexibility in radial direction 76. When angle grinder 66 is assembled—which is carried out as described for insulation means 70*a*—a rib (which is not shown in the figures) of angle grinder 66 also engages in gap 100. As a result, a high level of stability of insulation means 70*b* in assembled angle grinder 66 and a good seal of inner space 98 to the outside can be attained.

What is claimed is:

1. A portable power angle grinder, comprising:

a motor housing (22*a*, 22*b*, 22*c*, 22*d*, 68;

a housing cover (26*a*, 26*b*, 26*c*, 26*d*, 72) attached to the motor housing (22*a*, 22*b*, 22*c*, 22*d*, 68) by sliding the housing cover in an axial direction onto the motor housing;

an insulation means (44*a*, 44*b*, 44*c*, 44*d*, 70*a*, 70*b*); and a guide means (50*a*, 50*b*, 50*c*, 50*d*, 52*a*, 52*b*, 52*d*, 92), wherein said insulation means (44*a*, 44*b*, 44*c*, 44*d*; 70*a*, 70*b*) abuts on said motor housing (22*a*, 22*b*, 22*c*, 22*d*, 68) and on said housing cover (26*a*, 26*b*, 26*c*, 26*d*, 72), wherein said insulation means (44*a*, 44*b*, 44*c*, 44*d*, 70*a*, 70*b*) is guided via said guide means (50*a*, 50*b*, 50*c*, 50*d*, 52*a*, 52*b*, 92) toward the motor housing (22*a*, 22*b*, 22*c*, 22*d*, 68), the housing cover (26*a*, 26*b*, 26*c*, 26*d*, 72), or both said motor housing (22*a*, 22*b*, 22*c*, 22*d*, 68) and housing cover (26*a*, 26*b*, 26*c*, 26*d*, 72), wherein a contact surface of said insulation means abuts on a contact surface of said guide means, wherein said guide means (50*a*, 50*b*, 50*c*, 50*d*, 52*a*, 52*b*, 52*d*, 92) is provided to prevent a displacement of the contact surface of said insulation means (44*a*, 44*b*, 44*c*, 44*d*, 70*a*, 70*b*) relative to the contact surface of said guide means in an axial direction when said housing cover (26*a*, 26*b*, 26*c*, 26*d*, 72) is slid in an axial direction onto said motor housing (22*a*, 22*b*, 22*c*, 22*d*, 68), and wherein the housing cover is shaped like a cup and is attached to the motor housing in the axial direction;

wherein said insulation means as a whole is located exclusively radially between said motor housing and said housing cover, and said guide means have no components extending radially and preventing a sliding of the housing cover onto the motor housing in the axial direction.

2. The portable power angle grinder as recited in claim 1, wherein the guide means (50*a*, 50*b*, 52*a*) are part of a shoulder (46*a*, 46*b*, 48*a*) in the motor housing (22*a*, 22*b*) or in the housing cover (26*a*).

3. The portable power angle grinder as recited in claim 1, wherein the insulation means (70*a*, 70*b*) include recesses (90*a*, 90*b*).

4. The portable power angle grinder as recited in claim 3, further comprising interior elements (78), wherein said interior elements (78) are located inside the motor housing (68), the housing cover (72), or inside both the motor housing (68) and the housing cover (72), and wherein said interior elements (78) engage in the recesses (90*a*, 90*b*).

5. The portable power angle grinder as recited in claim 1, wherein the insulation means (44*c*) are bonded with the motor housing (22*c*), the housing cover (26*c*), or both the motor housing (22*c*) and housing cover (26*c*).

6. The portable power angle grinder as recited in claim 1, wherein the insulation means (44*d*) have at least two parallel outer surfaces (60, 62), and wherein in the installed state, at least one of said outer surfaces (60, 62) bears against the motor housing (22*d*) and the other of said outer surface (60, 62) bears against the housing cover (26*d*).

7. The portable power angle grinder as recited in claim 1, wherein the insulation means (44*d*) include at least one recess (64) formed in the axial direction (28).

8. The portable power angle grinder as recited in claim 1, wherein the insulation means (70*b*) bear against the motor housing (68) and the housing cover (72) in an open, annular manner and include a gap (100) in the radial direction (76).

9. The portable power angle grinder as recited in claim 1, wherein the insulation means (44*a*, 44*b*, 70*a*, 70*b*) are configured to be preloaded in the radial direction (30, 76), and wherein said insulation means (44*a*, 44*b*, 70*a*, 70*b*) are installed on the motor housing (22*a*, 22*b*, 68) or the housing cover (26*a*, 26*b*, 72).

10. The portable power angle grinder as recited in claim 1, wherein the insulation means (44*b*) surround the housing cover (26*c*) or the motor housing (22*b*) in the shape of an L.

11. The portable power angle grinder as recited in claim 1, further comprising a stop (58), wherein said stop prevents the insulation means (44*d*) from being compressed completely.

12. The portable power angle grinder as recited in claim 1, wherein said at least one guide means is formed as a rib located on an inner surface of said housing cover.

13. The portable power angle grinder as recited in claim 1, wherein said insulation means is ring-shaped and includes recesses and a gap, wherein said gap extends substantially in a radial direction of said ring-shaped insulation means.

14. The portable power angle grinder as recited in claim 13, wherein in a mounted state of said insulation means a rib of said portable power tool engages with said gap.

15. The portable power angle grinder as recited in claim 1, wherein said insulating means is located as a whole between an inner surface of said housing cover and an outer surface of said motor housing as considered in a radial direction and bears in a closed, annular manner against said inner surface of said housing cover and said outer surface of said motor housing in a radial gap between said housing cover and said motor housing.

16. The portable power angle grinder as recited in claim 1, wherein said housing cover and said motor housing have end portions facing one another and each provided with a shoulder having a first section oriented in a radial direction and a second section forming said guiding means and oriented exclusively in an axial direction, said insulating means being located as a whole exclusively radially between said second sections of said shoulders of said housing cover and said motor housing, said second sections of said shoulders forming said guiding means of said housing cover and said motor housing, which second section extending toward each other and are devoid of any components extending radially and preventing the sliding of the housing cover onto the motor housing in the axial direction.

17. A portable power angle grinder, comprising:

a motor housing;

a housing cover attached to the motor housing by sliding the housing cover in an axial direction onto the motor housing;

an insulation means; and a guide means, wherein said insulation means abuts on said motor housing and on said housing cover, wherein the guide means is a part of a shoulder in the motor housing or in the housing cover or in both, and wherein the shoulder is built by a reduction of a wall thickness of the motor housing or the housing cover or both, wherein said insulation means is guided via said guide means toward the motor housing, the housing cover, or both said motor housing and housing cover, wherein a contact surface of said insulation means abuts on a contact surface of said guide means, and wherein said guide means is provided to prevent a displacement of the contact surface of said insulation means relative to the contact surface of said guide means in the axial direction when said housing cover is slid in the axial direction onto said motor housing, wherein the housing cover is shaped like a cup and is attached to the motor housing in the axial direction;

wherein said insulation means as a whole is located exclusively radially between said motor housing and said housing cover, and said guide means have no components extending radially and preventing a sliding of the housing cover onto the motor housing in the axial direction.

18. A portable power angle grinder, comprising:

a motor housing;

a housing cover attached to the motor housing by sliding the housing cover in an axial direction onto the motor housing;

an insulation means; and a guide means, wherein said insulation means abuts on said motor housing and on said housing cover, wherein said insulation means is guided via said guide means toward the motor housing, the housing cover, or both said motor housing and housing cover, wherein a contact surface of said insulation means abuts on a contact surface of said guide means, and wherein said guide means is provided to prevent a displacement of the contact surface of said insulation means relative to the contact surface of said guide means in an axial direction when said housing cover is slid in the axial direction onto said motor housing, wherein the housing cover is shaped like a cup and is attached to the motor housing in the axial direction, wherein the cup-shaped housing cover has a longitudinal axis and a lateral surface formed by a side wall of the housing cover, wherein the side wall fully encompasses the longitudinal axis, and wherein the side wall of the housing cover is formed in one piece;

wherein said insulation means as a whole is located exclusively radially between said motor housing and said housing cover, and said guide means have no components extending radially and preventing a sliding of the housing cover onto the motor housing in the axial direction.

19. The portable power angle grinder as recited in claim 18, wherein the cup-shaped housing cover comprises a cone-shaped lateral surface.

20. The portable power angle grinder as recited in claim 18, wherein the housing cover is rotation-symmetrically constructed and the side wall is straight and integrally formed, and wherein the housing cover comprises a circular base which is connected to the side wall.

21. The portable power angle grinder as recited in claim 18, wherein the axis around which the side wall is arranged corresponds in a mounted state of the housing cover to a longitudinal axis of the portable power tool.

22. A portable power angle grinder, comprising:

a motor housing;

a housing cover attached to the motor housing by sliding the housing cover in an axial direction onto the motor housing;

an insulation means; and a guide means, wherein said insulation means abuts on said motor housing and on said housing cover, wherein the guide means is a part of a shoulder in the motor housing or in the housing cover or in both, and wherein the shoulder is built by a reduction of a wall thickness of the motor housing or the housing cover, or both wherein said insulation means is guided via said guide means toward the motor housing, the housing cover, or both said motor housing and housing cover, wherein a contact surface of said insulation means abuts on a contact surface of said guide means, and wherein said guide means is provided to prevent a displacement of the contact surface of said insulation means relative to the contact surface of said guide means in the axial direction when said housing cover is slid in the axial direction onto said motor housing, wherein the housing cover is shaped like a cup and is attached to the motor housing in the axial direction, wherein the cup-shaped housing cover has a longitudinal axis and a lateral surface formed by a side wall of the housing cover, wherein the side wall fully encompasses the longitudinal axis, and wherein the side wall of the housing cover is formed in one piece;

wherein said insulation means as a whole is located exclusively radially between said motor housing and said housing cover, and said guide means have no components extending radially and preventing a sliding of the housing cover onto the motor housing in the axial direction.

* * * * *